United States Patent [19]

Eakins

[11] 4,080,672

[45] Mar. 28, 1978

[54] SOFA BED FOLDING FIXTURE

[75] Inventor: Paul W. Eakins, St. Louis, Mo.

[73] Assignee: The Foster Brothers Manufacturing Company, St. Louis, Mo.

[21] Appl. No.: 796,222

[22] Filed: May 12, 1977

[51] Int. Cl.[2] ..... A47C 13/14

[52] U.S. Cl. ..... 5/13; 5/29

[58] Field of Search ..... 5/13, 18, 29, 37, 38

[56] References Cited

U.S. PATENT DOCUMENTS

| | | | |
|---|---|---|---|
| 3,281,871 | 11/1966 | Katz | 5/13 |
| 3,525,106 | 8/1970 | Perry | 5/13 |
| 3,636,572 | 1/1972 | Eakins | 5/13 |
| 3,934,281 | 1/1976 | Eakins | 5/13 |

*Primary Examiner*—Casmir A. Nunberg

*Attorney, Agent, or Firm*—Koenig, Senniger, Powers and Leavitt

[57] ABSTRACT

A four-section rise-over sofa bed fixture having a head section, a body section, an intermediate section and a foot section all pivotally connected together in end-to-end relationship and adapted to be folded from an extended coplanar position to a retracted position within a sofa. The fixture has at each side thereof a support to be mounted on the base of the sofa at the respective side thereof, a locking mechanism for locking the foot section in its retracted position, linkage interconnecting the support and the locking mechanism, and folding legs for supporting the body, intermediate and foot sections.

3 Claims, 4 Drawing Figures

SOFA BED FOLDING FIXTURE

BACKGROUND OF THE INVENTION

This invention relates to sofa beds and, more particularly, to a folding fixture for a sofa bed.

The invention is especially concerned with a folding fixture for a sofa bed of the type referred to in the art as a four-section rise-over fixture, comprising a head section, a body section, an intermediate section and a foot section (the outer section) pivoted together end-to-end. When unfolded, the fixture extends horizontally forward from adjacent the back of the sofa over the front rail of the sofa, the foot, intermediate and body sections being supported on legs which unfold as the fixture is swung out of the sofa and unfolded. The fixture is adapted for folding over of the foot section on top of the body section and retraction of the entire fixture into the sofa with the head section extending upward within the back of the sofa, the body section extending generally horizontally forward from the lower end of the head section, the intermediate section extending upward from the forward end of the body section immediately behind the front rail of the base of the sofa, and the foot section extending horizontally rearward from the upper end of the intermediate section. The foot section then constitutes a support for the seat cushion (s) of the sofa. In extending the fixture for use as a bed, after removal of the seat cushion (s) of the sofa, the intermediate section is pulled up from behind the front rail and the fixture is raised up and out over the front rail (hence the description of the fixture as a "rise-over" fixture) to extend the head section, and body section, after which the foot section and intermediate section are unfolded. It will be understood that the fixture comprises two suitably cross-connected opposite side assemblies with a bedspring structure extending therebetween for supporting a mattress, and that, in folding up the fixture, the mattress is correspondingly folded, and is retracted, in its folded condition, into the sofa along with the fixture.

Fixtures of the type above-described are wellknown in the art and have now been on the market for a number of years but have oftentimes presented a problem in that the expansion tendencies of the mattress in its folded position within the sofa has tended to push the foot section of the folding fixture upwardly against the seat cushion or cushions on the sofa. In an attempt to solve this problem, mechanisms for locking the foot section in its generally horizontal retracted position have heretofore been suggested as exemplified by U.S. pat. Nos. 3,934,281, 3,525,106, 3,281,871, 3,281,870 and applicant's U.S. pat. No. 3,636,572.

SUMMARY OF THE INVENTION

Among the several objects of this invention may be noted the provision of an improved four-section rise-over sofa bed fixture of the type above-described having an improved locking mechanism for positively and strongly pulling the foot section down toward the body section thereby to hold the mattress in its folded condition when the fixture is in its retracted position within the sofa; the provision of such improved locking mechanism which is of simplified construction involving a minimum number of separate parts for more efficient and economical construction; and the provision of such a fixture which is easily and smoothly moved between its extended and retracted positions.

In general, a folding fixture made in accordance with this invention includes a head section, a body section, an intermediate section and a foot section all pivotally connected together in end-to-end relationship and adapted to be folded from an extended coplanar position to a retracted position in the sofa wherein the body section extends generally horizontally bottomwise within the sofa with the intermediate section extending upwardly from the forward end of the body section at the front of the sofa and with the foot section extending generally horizontally rearward from the upper end of the intermediate section. The fixture has at each side thereof a support adapted to be mounted on the base of the sofa at a respective side of the base, means for locking the foot section in its retracted position, linkage interconnecting the support and the locking means and folding legs for supporting the body and foot sections. The locking means comprises a link for actuating the leg of the body section, a first bellcrank pivoted on the side of the body section and having a pivotal connection at its rearward end to the aforementioned linkage and at its forward end to the leg-actuating link, a second locking bellcrank pivoted intermediate its ends to said intermediate section and having at its rearward end a pin and slot connection with the side of the body section forward of the first bellcrank, a locking link interconnecting the locking bellcrank and the leg-actuating link, the locking link being pivoted at its forward end to said locking bellcrank and having at its rearward end a pin and slot connection with the leg-actuating link, and a pulling arm interconnecting the locking bellcrank and the foot section for holding the foot section in its folded position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
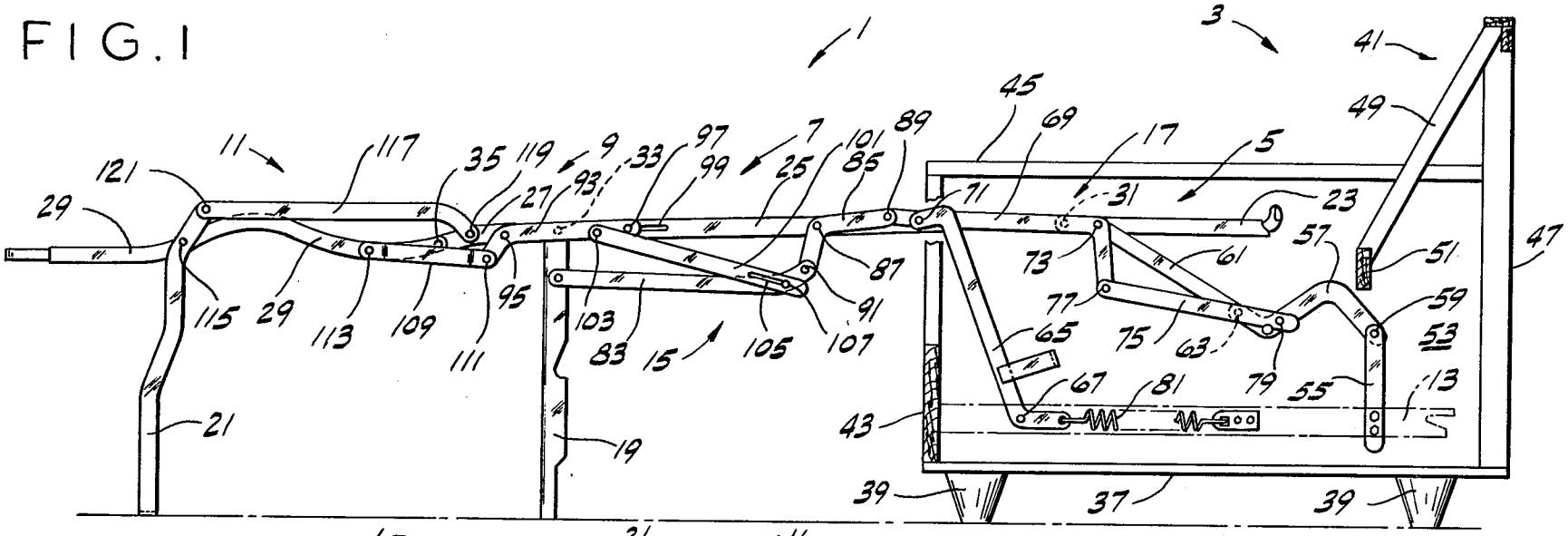
FIG. 1 is a view in elevation of one side of a sofa frame having a fixture and locking mechanism of this invention installed therein, the fixture being shown in its extended coplanar position.

Referring to the drawings, reference numeral 1 indicates in its entirety a four-section rise-over folding fixture of this invention for a sofa, the frame of which is generally indicated at 3. The fixture has a head, body, intermediate and foot sections 5, 7, 9 and 11, respectively, all pivotally connected together in end-to-end relationship. These four sections 5, 7, 9 and 11 are adapted to be folded from an extended coplanar position (as shown in FIG. 1) to a retracted or collapsed position within the sofa (FIG. 4) wherein the body section 7 extends generally bottomwise within the sofa with the intermediate section 9 extending upwardly from the forward end of the body section at the front of the sofa and with the foot section 11 extending horizontally rearward from the upper end of the intermediate section.

The fixture 1 has at each side thereof a support such as indicated at 13 which is adapted to be mounted on the sofa at a respective side thereof, means generally indicated at 15 for locking the foot section in its retracted position, linkage generally shown at 17 for interconnecting the support 13 and the locking means 15, and two folding legs 19, 21 for supporting the body, intermediate and foot sections 7, 9 and 11, respectively.

More particularly, the head section 5 is shown as including a pair of side bars, one of which appears in the drawings and which is designated 23. It will be understood that the bar at the other side of the fixture is similar. The body section 7 also comprises a pair of side bars one of which is shown at 25, and the intermediate section 9 consists of two side bars, one of which is indicated at 27. Similarly the outer or foot section 11 comprises a pair of side bars also, only one of which is shown at 29. The pivotal connection between the head section 5 and the body section 7 is indicated at 31 while the pivotal connection between the body section 7 and the intermediate section 9 is indicated at 33 and the pivotal connection between the intermediate section and the foot section 11 is designated 35. Although not shown in the drawings, it will be readily understood by those skilled in the art that a mattress-supporting bedspring spans the side bars 23, 25, 27 and 29, the bedspring being connected at its sides to the side bars.

The sofa frame 3, as herein illustrated, comprises a base 37 on legs 39, a back frame structure 41, a front rail 43 and end frames 45. The back frame structure, as shown, includes a vertical back frame 47 and an inclined front frame 49 having a lower horizontal member 51 extending between the end frames with the bottom edge of member 51 at an elevation somewhat above the elevation of the top edge of the front rail 43. The front and back frames 49 and 47 of the sofa back frame structure 41 define a chamber 53.

As illustrated in the drawings, the support 13 is constituted by an elongate metal plate which is mounted in position extending generally horizontally on the inside of the respective end frame 45 of the sofa frame (it will be understood that there are two such plates, one at each side of the fixture), and a post 55 extending up from the plate adjacent one end constituting its rearward end and in a vertical plane immediately rearward of member 51 of the frame of the sofa.

Linkage 17 for interconnecting the support 13 and the locking means 15 of the folding fixture 1 comprises a first arm 57 generally of S-shape and pivoted for swinging movement at 59 on a horizontal axis extending in end-to-end direction with respect to the sofa at the upper end of the post 55. A head section support link 61 interconnects arm 57 and the pivotal connection indicated at 31 between the head section 5 and the body section 7. This link 61 is pivoted on the inside of the arm 57 at its free end as shown at 63. The side bars 23 of the head section are connected at their rearward ends by a cross bar (not shown) and this assembly constitutes a headrest section adapted to be supported from the side bar 23 in any suitable manner. Linkage 17 is further constituted by a second arm 65 pivoted at its lower end for swinging movement on the support 13 at 67 about a horizontal axis parallel to, below and forward of the pivotal axis of the first arm 57, pivot 67 being located adjacent the front end of support 13. The upper end of arm 65 is pivoted on the outside of a lever 69 intermediate the ends of the lever as indicated at 71. As best shown in FIG. 1, lever 69 is pin-connected to head support link 61 at 73 and has its rearward end angled downwardly toward a link 75 for a pin connection with the latter as shown at 77. Link 75, in turn, is pivoted at its rearward end to the S-shaped arm 57 at pin connection 79. A counterbalance spring is indicated at 81 for interconnecting the lower end of arm 65 and the support 13.

Figure 4:
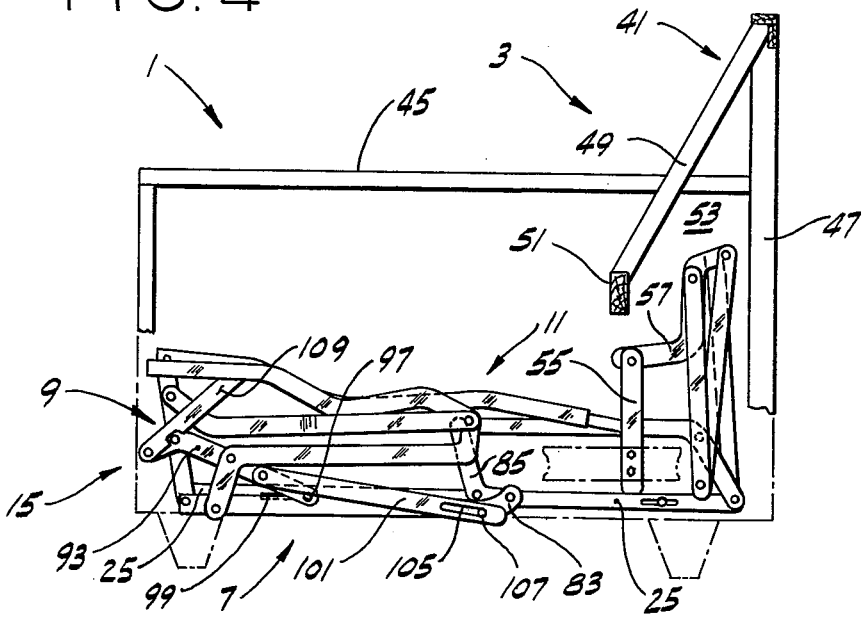
FIG. 4 is another view showing the fixture in its retracted position with the foot section locked in a generally horizontal position.

As hereinbefore mentioned, means 15 is provided for locking the foot section 11 down against the expansion tendency of the folded mattress when the fixture 1 is in its retracted position (as shown in FIG. 4). This means includes a link 83 for actuating folding leg 19 of the body section, this leg being pivoted at its upper end as indicated at 33 on the side of the body section 7 adjacent its front end. A first bellcrank 85 is pin-connected at 87 on the outside of bar 25 of the body section 7 at about midway of the length of the latter, and has a pivotal connection at its rearward end as indicated at 89 to linkage 17 (and more particularly to the forward end of lever 69) and at its forward end as shown at 91 to the leg-actuating link 83. With the folding fixture 1 in its extended position as illustrated in FIG. 1, the rearward end of link 83 extends generally upwardly and rearwardly for connection at 91 to the bellcrank 85. A second locking bellcrank 93, the forward end of which is shown to extend generally downwardly and forwardly, is pivoted intermediate its ends via pin connection 95 to the side bar 27 of the intermediate section 9 and has at its rearward end a pin and slot connection with the side of the body section 7 forward of the bellcrank 85. The pin of this connection is on the locking bellcrank 93, being indicated at 97, and the slot, indicated at 99, is in the side bar 25.

Figure 2:
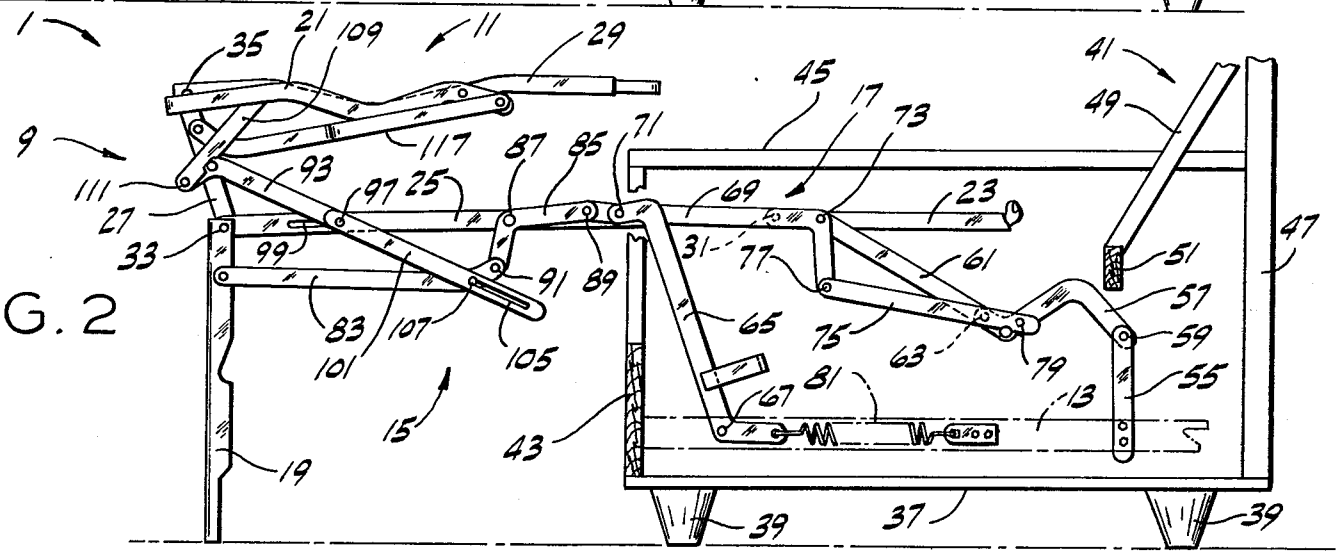
FIG. 2 is a view corresponding to FIG. 1 showing the fixture in a partially folded position.
Figure 3:
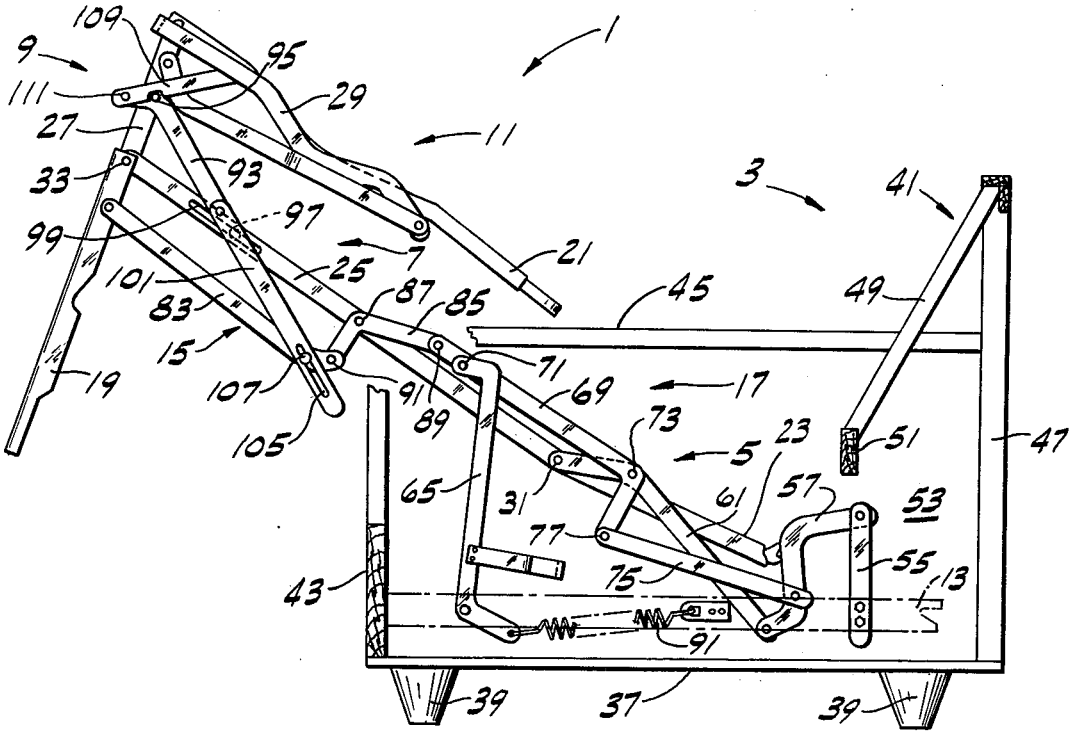
FIG. 3 is a view similar to FIGS. 1 and 2 showing the fixture being swung over the front rail of the sofa toward its completely collapsed or retracted position within the sofa.

Locking means 15 further comprises a locking link 101 which interconnects the locking bellcrank 93 and the leg-actuating link 83, the locking link 101 being pivoted at its forward end as shown at 103 to bellcrank 93 forward of the pin and slot connection between the locking bellcrank and the side of the body section. At its rearward end, locking link 101 has a pin-and-slot connection with the leg-actuating link 83 forward of the pin connection 91 between the first bellcrank 85 and link 83. The slot of this connection between link 101 and the leg-actuating link 83 is in link 101 and is indicated at 105 while the pin, indicated at 107, is on link 83. A pulling arm 109 for interconnecting the forward end of locking bellcrank 93 and the side bar 29 of the foot section is also provided for holding the foot section 11 in its retracted position. This pulling arm 109 has a pin connection at 111 to the forward end of the bellcrank 93 and is pivotally connected at 113 to bar 29. When the foot section is in its folded position extending rearwardly over the body section 7 as shown in FIGS. 2–4, the pulling arm extends generally diagonally across the corner of the intermediate and foot sections for pulling the foot section 11 toward the body section 7 and locking the foot section in its retracted position.

The folding leg 21 is pivoted at 115 on the outside of the side bar 29 of foot section 11 adjacent its front end for supporting the foot section. A link 117 interconnects the outside of side bar 27 of the intermediate section 9 at 119 and the upper end of leg 21 at 121 for folding and unfolding the latter.

The operation of this folding fixture 1, and more particularly the locking mechanism 15, is as follows:

FIG. 1 shows the four-section rise-over frame in its fully extended and coplanar position. In this position the pin 97 on the locking bellcrank 93 is at the left (forward) end of slot 99 in side bar 25 and the pin 107 on the leg-actuating link 83 is at the far right (rear) of the slot 105 in the locking link 101.

Referring now to FIG. 2 in which the foot section 11 has been folded to a position in which it extends generally horizontally rearward from the pivot 35 at the upper end of the intermediate section 9, it will be seen that the locking bellcrank 93 has generally come into linear alignment with the locking link 101 and that the pulling link 109 has moved to a position in which it extends diagonally across the corner of the foot and intermediate sections for interconnecting the locking bellcrank and the foot section. In addition, the pin 97 of the locking bellcrank 93 and the pin 107 of the leg-actuating link 83 have moved to the opposite ends of their respective slots (to the right and left ends, respectively). It will be understood, however, that the foot section 11 as shown in FIG. 2 is not locked down in position. Thus, the expansion tendency of a mattress (not shown) might force the foot section upwardly (at least to some extent) which would cause pin 97 of the locking bellcrank to move forwardly (to the left) in slot 99 of side bar 25.

The fixture 1 may then be folded to a position such as shown in FIG. 3 by simultaneously pulling up on the intermediate section 9 and pushing it toward the sofa which causes the parts to assume the position shown, with the foot section 11 still folded completely over relative to the body section 7, and with these two sections angled upwardly and forwardly. During this folding action, the linkage 17 causes the first bellcrank 85 to pivot counterclockwise about the pin connection 87, thus actually beginning the locking sequence of the foot section 11 relative to the body section 7. As bellcrank 85 swings counterclockwise about its pivot, it pulls the leg-actuating link 83 and the pin 107 thereon downwardly and to the right in slot 105 and away from the locking bellcrank 93. This continuous movement of the pin 107 away from the locking bellcrank gradually limits, via the locking link 101, the upward and forward reach of the pin 97 (on locking bellcrank 93) in the slot 99. Inasmuch as the degree to which the foot section 11 is able to unfold is a direct function of the extent of such reach, it will be readily understood that the rotation of the bellcrank 85 and resulting movement of the leg-actuating link 83 and the pin 107 gradually restricts the extent to which the foot section 11 can unfold. With the pin 107 in the position shown in FIG. 3, for example, the foot section 11 would be unable to unfold more than approximately 30 degrees relative to the body section 7. Concomitantly, the pivotal movement of the bellcrank 85 also causes, via leg-actuating link 83, the leg 19 of the body section 7 to fold upwardly toward a position against the body section.

The fixture 1 is then folded from the position shown in FIG. 3 to the completely collapsed position shown in FIG. 4 by pushing the partially folded fixture downwardly and to the rear, thus causing the fixture to swing over the front rail 43 to a position within the sofa frame 3 wherein the mattress is folded up on itself between the foot section 11 and the body section 7 with the fold at the intermediate section, and with the head end portion of the mattress folded up on the front side of the head section 13 which extends up into the chamber 53. As the fixture is so folded, the bellcrank 85 continues to swing counterclockwise and to pull the leg-actuating link 83 and the pin 107 downwardly and to the right until the pin 107 is bottomed out at the right or lower end of the slot 105 and the pin 97 is at the extreme right of the slot 99 in the side bar 25. At this point, any movement of the pin 97 (and thus the locking bellcrank 93) toward the left in the slot 99 is prevented by the locking link 101, and thus, with the pulling link 109 pulling the foot section downwardly, the foot section 11 is completely locked down against the expansion tendencies of the mattress.

As will be readily understood, the unfolding of the fixture involves the reverse of the above procedure.

The improved locking mechanism of this invention is of simplified construction and involves a minimum number of parts for more efficient and economical construction. Moreover, it constitutes an effective locking arrangement for positively and strongly pulling the foot section down toward the body section so as to hold the mattress in folded position when the foot section is retracted within the sofa. The fixture as described above with such an improved locking mechanism is also adapted to be easily and smoothly folded into the sofa as well as easily and smoothly unfolded to its extended position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A folding fixture for a sofa bed comprising a head section, a body section, an intermediate section and a foot section all pivotally connected together in end-to-end relationship and adapted to be folded from an extended coplanar position to a retracted position in the sofa wherein the body section extends generally horizontally bottomwise within the sofa with the intermediate section extending upwardly from the end of the body section constituting its forward end at the front of the sofa and with the foot section extending generally horizontally rearward from the upper end of the intermediate section, said fixture having at each side thereof;

a support adapted to be mounted on the base of the sofa at the respective side thereof;

means for locking the foot section in its retracted position;

linkage interconnecting said support and said locking means;

a folding leg for supporting the body section;

a folding leg for supporting the foot section;

said locking means comprising, a link for actuating the leg of the body section;

a first bellcrank pivoted on the side of the body section and having a pivotal connection at its rearward end to said linkage and at its forward end to said leg-actuating link;

a second locking bellcrank pivoted intermediate its ends to said intermediate section and having at its rearward end a pin and slot connection with the side of the body section forward of said first bellcrank, the forward end of said locking bellcrank extending generally downwardly and forwardly when said folding fixture is in its extended position;

a locking link interconnecting said locking bellcrank and said leg-actuating link, said locking link being pivoted at its forward end to said locking bellcrank and having at its rearward end a pin and slot connection with the leg-actuating link forward of said connection between the first bellcrank and the leg-actuating link; and a pulling arm interconnecting said locking bellcrank and the foot section for holding the foot section in said folded position, said pulling arm being pivotally connected to the forward end of the locking bellcrank and extending generally diagonally across the corner of the intermediate and foot sections when the folding fixture is in its retracted position.

2. A folding fixture for a sofa bed as set forth in claim 1 wherein the rearward end of said leg-actuating link extends generally upwardly and rearwardly for connection to said first bellcrank when the folding fixture is in its extended position.

3. A folding fixture for a sofa bed as set forth in claim 1 wherein said locking link is pivoted to said locking bellcrank forward of the pin and slot connection between the locking bellcrank and the side of the body section when the folding fixture is in its extended position.

* * * * *